US005115615A

United States Patent [19]

Miyake et al.

[11] Patent Number: 5,115,615

[45] Date of Patent: May 26, 1992

[54] FLOOR VIBRATION-DAMPING APPARATUS

[75] Inventors: Hiraku Miyake; Mitsuo Ishiguro; Shigetaka Abe; Nobuo Yamaguchi; Yutaka Hayamizu; Satoru Aizawa, all of Tokyo, Japan

[73] Assignee: Takenaka Corporation, Osaka, Japan

[21] Appl. No.: 657,071

[22] Filed: Feb. 19, 1991

[51] Int. Cl.[5] ..... E04H 9/02

[52] U.S. Cl. ..... 52/167 R; 52/480; 248/638

[58] Field of Search ..... 52/167 R, 480; 248/562, 248/636, 638; 16/52, 82

[56] References Cited

U.S. PATENT DOCUMENTS

| | | | |
|---|---|---|---|
| 1,743,360 | 1/1930 | Lang | 16/52 |
| 4,330,103 | 5/1982 | Thuries et al. | 248/562 |
| 4,805,359 | 2/1989 | Miyake et al. | 52/167 |

*Primary Examiner*—James L. Ridgill, Jr.
*Attorney, Agent, or Firm*—Dellett, Smith-Hill and Bedell

[57] ABSTRACT

A floor vibration-damping apparatus damps a horizontal vibration of a floor based on an earthquake or the like. This apparatus comprises a movable supporting portion for supporting a floor with being free to move horizontally, and a damper working portion made by a combination of a viscous damper fixed to a restricted position of the floor and a plurality of spring mechanisms positioned radiately with respect to the restricted position.

12 Claims, 3 Drawing Sheets

FLOOR VIBRATION-DAMPING APPARATUS

BACKGROUND OF THE INVENTION

The present invention relates generally to a floor vibration-damping apparatus for a floor of a building on which vibration sensitive office automation equipment, such as computers, is provided, and in particular to a floor vibration-damping apparatus comprising a movable supporting portion for an anti-vibration floor, a damper for attenuation effect and a spring mechanism for restoring effect.

A conventional floor vibration-damping apparatus comprises a movable supporting portion for supporting an anti-vibration floor which is free to move horizontally and a spring damper working portion provided between the anti-vibration floor and a building floor (fixed floor). Such a floor vibration-damping apparatus is disclosed, for example, in Japanese Published Unexamined Patent Application No. 62-86265 (corresponding to U.S. Pat. No. 4,805,359).

In the floor vibration-damping apparatus disclosed in Japanese Published Unexamined Patent Application No. 62-86265, the spring damper is a viscous type damper wherein a shallow and flat vessel is fixed to the fixed floor and accommodates viscous fluid. A resistance plate is submerged in the viscous fluid in parallel with a bottom surface of the vessel and a distance therebetween is a constant. This resistance plate is fixed to the anti-vibration floor. Tension coil springs are provided radially relative to a neutral position of the resistance plate. One end of each tension coil spring is attached to the resistance plate and the opposite end is attached to the fixed floor.

However, in the floor vibration-damping apparatus discussed in Japanese Published Unexamined Patent Application No. 62-86265, the damper working portion includes trigger function means for triggering the damper working portion when receiving a predetermined load. In order to accomplish such a trigger function means, a side wall of the vessel is formed as a reaction receiving portion, and a stiff flat bar is provided between the coil spring and the reaction receiving portion. Moreover, a stopper is mounted on the flat bar such that the stopper touches the reaction receiving portion, and the flat bar is coupled with the neutral position of the resistance plate by a chain. Thus, the damper working portion works mutually in relation to the spring portion and the damper portion, and an operation of establishing the trigger function should be done at a building site. As a result, it is troublesome to assemble the damper working portion, and it takes a long time to set the damper working portion. In addition, it is difficult to make the trigger function with accuracy, and the trigger function affects the damper.

What is desired is a floor vibration-damping apparatus which is free from the aforementioned disadvantages.

SUMMARY OF THE INVENTION

A floor vibration-damping apparatus according to this invention is constructed for resolving the above discussed problems as shown in preferred embodiments in the attached drawings.

The floor vibration-damping apparatus comprises a movable supporting portion and a damper working portion. The movable supporting portion supports an anti-vibration floor so that the floor is free to move horizontally. The damper working portion is a combination of a viscous damper which is fixed to a desired position P of the anti-vibration floor and spring mechanisms positioned radially with respect to the desired restricted position P.

The viscous damper comprises a vessel and a resistance plate. The vessel accommodates viscous fluid and is fixed to a building. The resistance plate is submerged in the viscous fluid in parallel with a bottom surface of the vessel and a distance therebetween is a predetermined value. In addition, the resistance plate is fixed to the anti-vibration floor.

One end of the spring mechanism is coupled with the restricted position P of the anti-vibration floor through a flexible coupling member and the other end thereof is coupled with the fixed floor of the building. A pre-tension introduction mechanism is coupled with the coupling portion of the fixed floor in order to introduce a pre-tension for the trigger function. The spring mechanism self-holds the initial load value (pre-tension) for the trigger function.

According to the present invention, the spring mechanism used in the floor vibration-damping apparatus of the present invention comprises a plunger type cylinder having a plunger slidably provided in a cylinder and a tension spring wound around an outer surface of the plunger type cylinder. A front end of the tension spring is removably mounted to a spring latch portion which moves with the plunger. A tie rod is projected from a back end of the cylinder in order to couple with the building. An external thread is formed on the outer surface of the tie rod and a sleeve type dial is thrust into the external thread. A spring latch portion is rotatably provided at a back part of a sleeve portion of the dial. The back end of the tension spring is fixed to the spring latch portion of the back part, so that the pre-tension introduction mechanism is completed.

The flexible coupling member, such as a chain (wire or the like), is fixed to the plunger of the spring mechanism and extends toward the restricted position P. The chain is directly coupled with the restricted position of the anti-vibration floor.

The movable supporting portion supports the anti-vibration floor which is free to move horizontally with low resistance.

The damper working portion attenuates vibration of the anti-vibration floor based on an earthquake. Since the resistance plate in the viscous fluid produces a viscous resistance and the viscous damper of the damper working portion enhances the attenuation effect based on the viscous resistance in all directions, the anti-vibration floor can be prevented from being changed in shape when the earthquake occurs.

The spring mechanism makes a vibration period of the anti-vibration floor be longer and enhances the vibration-damping effect. Moreover, the spring mechanism makes the vibrated (or moved) anti-vibration floor to return an original neutral position.

When the dial as the trigger introduction mechanism of the spring mechanism is rotated clockwise or counterclockwise, the back spring latch portion moves forward and backward with respect to the front spring latch portion and the tension spring provided therebetween is compressed and expanded by the thread or screw operation of the tie rod. Since a spring power of the tension spring changes proportionally to the spring deviation, the initial load value pre-tension for the trigger function can be set or adjusted.

In a normal condition, the pre-tension for the trigger function introduced by the tension spring operates between the front and back spring latch portions of the cylinder, and the cylinder applies a reaction in order to maintain the balance therebetween (self-holding). Thus, the anti-vibration floor does not receive any force and a reaction receiving portion attached to the floor is not needed. The pre-tension magnitude can be widely set or adjusted at anytime with the thread operation by rotating the dial. This setting or adjustment can be done at anytime in any place, such as a factory or a building site. As a result, in normal condition, the anti-vibration floor is kept at the neutral position determined by a plurality of spring mechanisms positioned radiately with respect to the restricted position (resistance input portion).

If the earthquake input (horizontal input) value to the anti-vibration floor is less than the trigger set value, the anti-vibration floor keeps its static condition or is restricted to the neutral position by the spring mechanism.

If the anti-vibration floor receives its horizontal input value larger than the trigger set value, the anti-vibration floor is not restricted by the spring mechanisms positioned in the tension direction and the floor vibrates or moves horizontally. The viscous resistance of the viscous damper applies the attenuation effect to the vibration and the anti-vibration floor is prevented from being changed in shape. Simultaneously, the spring latch portion at the front end of the cylinder moves forward and pulls the tension spring, so that the righting moment is stored.

After a time when the vibration acceleration of the anti-vibration floor becomes zero, the floor is restored to the original state by the tension force of the tension spring. When the spring latch portion touches the front end of the cylinder, the spring effect ends. However, if the anti-vibration floor overruns the neutral position or moves in the opposite direction in the restoring operation, the spring mechanism at the opposite side (tension side) applies the restoring effect and the viscous damper applies the attenuation effect. At this time, in the spring mechanism positioned at the compressing direction side, the flexible coupling member is bent, the plunger does not receive any force and they do not affect the restoring effect.

The viscous damper applies a constant attenuation always in accordance with the movement direction of the anti-vibration floor regardless of the vibration direction.

Objects and advantages of the present invention will become apparent to those having ordinary skill in the art when taken in conjunction with the accompanying drawings.

DESCRIPTION OF THE PREFERRED EMBODIMENTS

The preferred embodiments of the present invention will be discussed by reference to the attached drawings.

Figure 1:
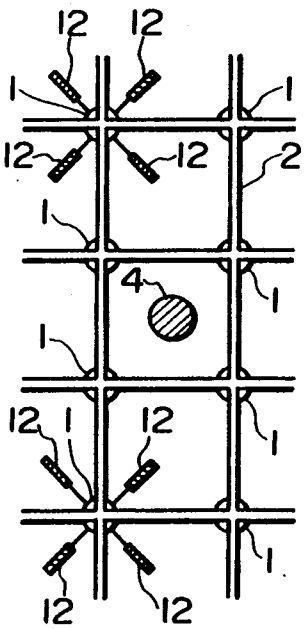
FIG. 1 shows a plan view of an entire construction and arrangement of a floor vibration-damping apparatus according to the present invention.

FIG. 1 shows a simple plan view of an entire construction of a floor vibration-damping apparatus according to the present invention. In this drawing, reference numbers 1, 4 and 12 represent a movable supporting portion, a viscous damper and a spring mechanism, respectively. The spring mechanisms extend radially relative to selected supporting portions.

Movable supporting portions 1 are arranged at proper intervals in consideration of load on anti-vibration floor 2, variation of the load and supporting stability. Anti-vibration floor 2 is made by a steel frame structure and is supported by movable supporting portions 1 using many steel balls 17 and floor 2 is free to move horizontally with low resistance. Movable supporting portion 1 comprises steel flat panels 18 and 18' which are fixed in parallel with facing positions of fixed floor 3 as a part of the building and anti-vibration floor 2. Many steel balls 17 are provided between these two steel flat panels 18 and 18', and the steel balls are restricted by retainer 19. Anti-vibration floor 2 can move horizontally with low resistance by rotation effect of steel balls 17.

Figure 2:
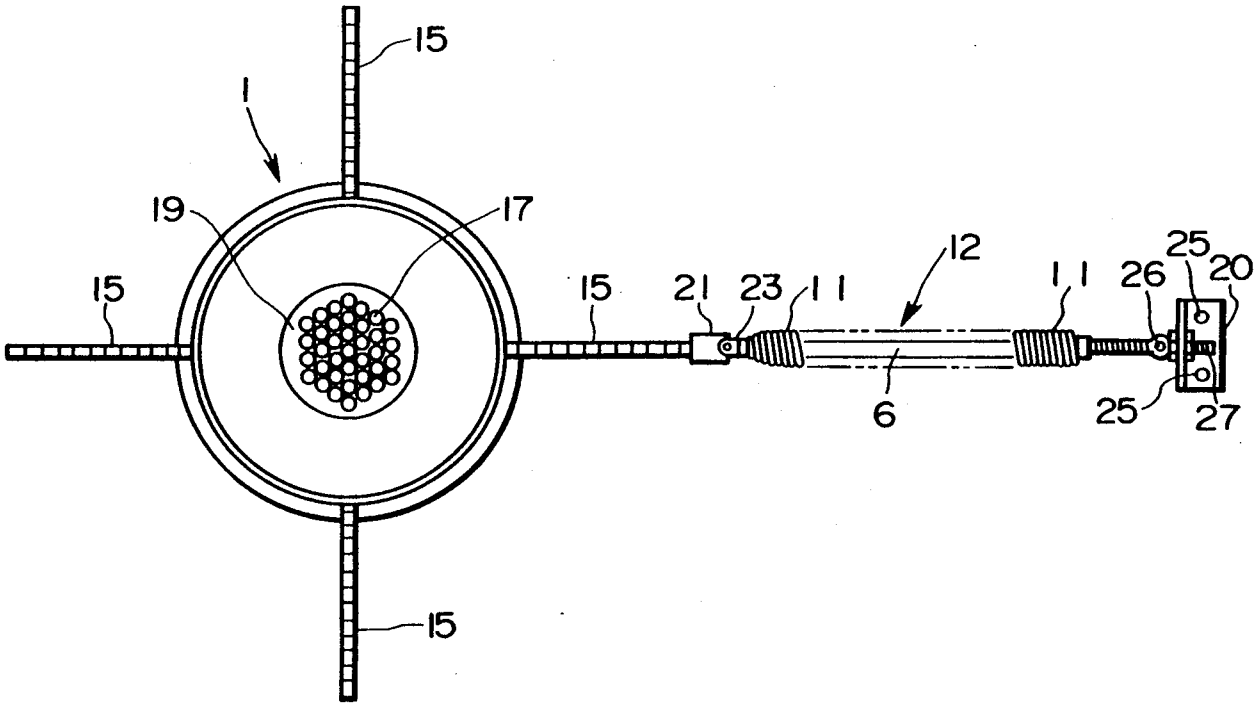
FIGS. 2 and 3 show plan and cross sectional views of a relationship between a movable supporting portion and a spring mechanism.
Figure 3:
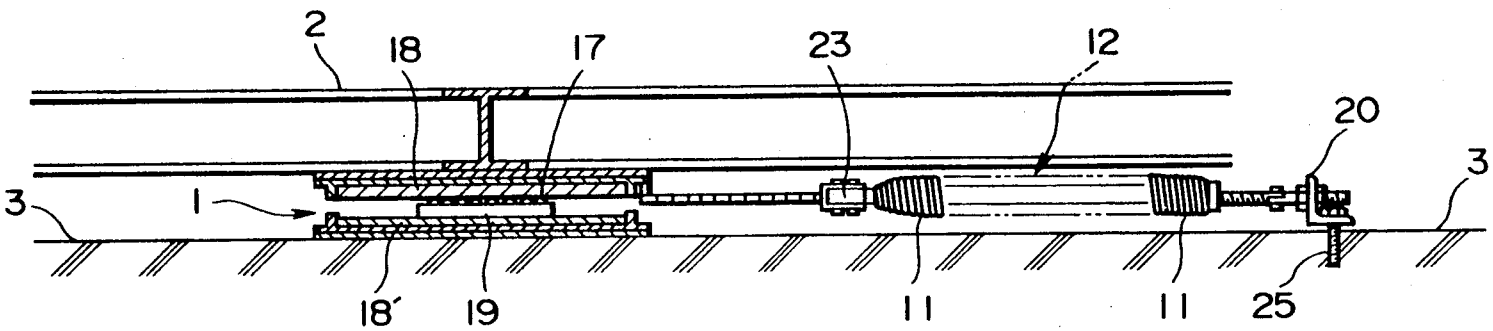

FIGS. 2 and 3 show a relationship and arrangement of movable supporting portion 1 and spring mechanism 12 in detail. In this embodiment, some of movable supporting portions 1 at selected positions are considered as restricted positions on anti-vibration floor 2, and spring mechanisms 12 are arranged horizontally in four directions at right angles with respect to one another (or three directions or any multi-directions) in the restricted position (movable supporting portion 1).

Figure 5:
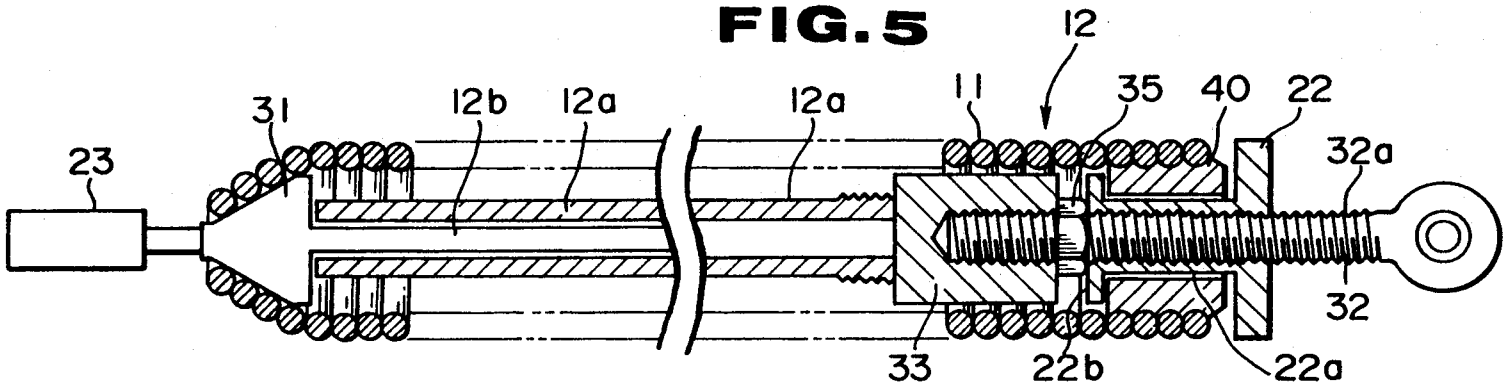
FIGS. 5 and 6 show cross sectional views for illustrating a construction and an operation of the spring mechanism.
Figure 6:
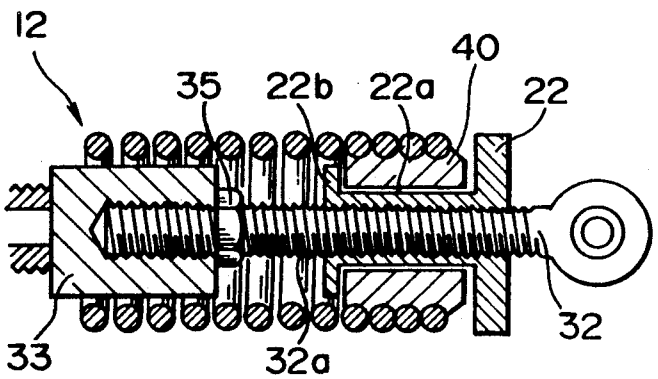

As shown in FIGS. 5 and 6 in detail, spring mechanism 12 comprises a plunger type cylinder having cylinder **12*a* and plunger 12*b* positioned slidably in cylinder 12*a*, and further comprises tension spring 11 which is wound around the outer surface of the plunger type cylinder. A front end of tension spring 11 touches movably spring latch portion 31 at a front end of cylinder 12*a*. Spring latch portion 31 moves simultaneously with plunger 12*b***.

A base end of tie rod 32 is thrust into cylinder head 33 at the back end of cylinder **12*a*, and tie rod 32 is fixed by lock nut 35 and projects in order to couple with the building. External thread 32*a* is formed on the outer surface of tie rod 32. Sleeve part 22*a* of sleeve type dial 22 is thrust into external thread 32*a* of tie rod 32, and back spring latch portion 40 is rotatably provided at sleeve part 22*a*. Spring latch portion 40 is not prevented from being removed by stop flange 22*b*. A back end of tension spring 11 is fixed to back spring latch portion 40**, so that a pre-tension introduction mechanism is completed.

As shown in FIGS. 2 and 3, tie rod 32 of spring mechanism 12 is coupled with bolt 27 and pin 26 to support angle member 20 provided at fixed floor 3 as a part of the building by anchor bolts 25. Joint 23 at the front end of plunger **12*b* is coupled with one end of chain 15 (or wire) by pin 21. The other end of chain 15 as a flexible coupling member is fixed to a pot shaped frame which restricts steel flat panel 18 at a side of anti-vibration floor 2 of movable supporting portion 1**.

If dial 22 of the pre-tension introduction mechanism is rotated, for example, clockwise, spring latch portion 40 moves to the right by a thread operation as shown in FIG. 6 and the distance between front spring latch portion 31 and back spring latch portion 40 increases. As a result, tension spring 11 is extended and larger pre-tension (initial load) is set. In a normal condition, this pre-tension works only between spring latch portions 31 and 40 wherein a reaction is produced by cylinder 12*a*. This mechanism provides a trigger function (trigger load) when anti-vibration floor 2 vibrates in response to the earthquake as input force.

Figure 4:
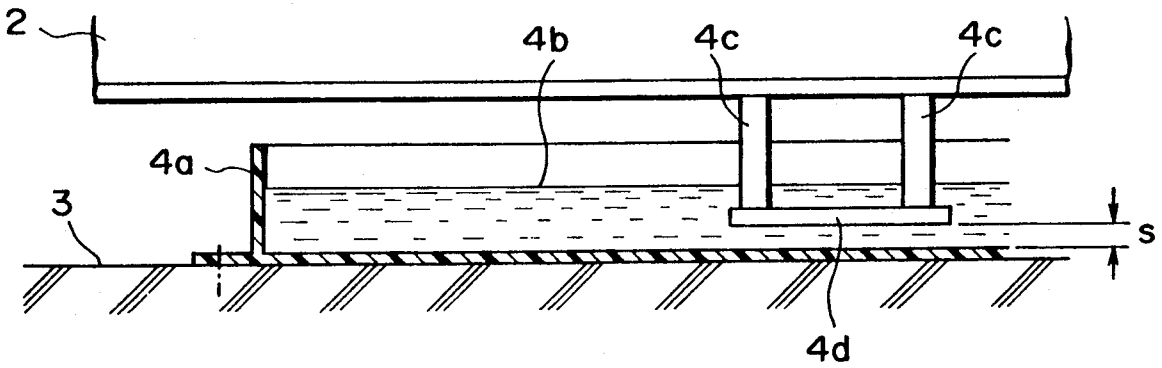
FIG. 4 shows a cross sectional view of a main portion of a viscous damper.

FIG. 4 shows a main construction of viscous damper 4 which is discussed in Japanese Published Unexamined Patent Application No 62-86265 (corresponding to U.S. Pat. No. 4,805,359). Shallow vessel 4*a* has a diameter of about 700 mm and a height of about 100 mm and accommodates viscous fluid 4*b* of macromolecule viscous material, such as silicon. Shallow vessel 4*a* is fixed to fixed floor 3 as a part of the building. Resistance plate 4*d* is fixed to bottom ends of poles 4*c* which extend from anti-vibration floor 2 downward. There is parallel and proper space S between resistance plate 4*d* and the bottom of shallow vessel 4*a*.

When anti-vibration floor 2 moves, viscous resistance is applied to resistance plate 4*d* submerged in viscous fluid 4*b* in order to produce an attenuation effect, wherein the viscous resistance is proportional to parallel space S. A mechanism (not shown) for adjusting the height of resistance plate 4*d* or parallel space S can be applied, if necessary.

Figure 7:
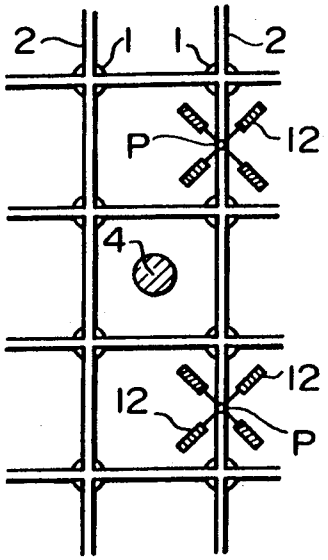
FIG. 7 shows a plan view of another construction and arrangement of the floor vibration-damping apparatus.

In the above discussed embodiment, as shown specially in FIG. 1, movable supporting portion 1 is determined as the restricted position of anti-vibration floor 2 and spring mechanisms 12 are arranged radially in four directions at right angles with respect to one another in movable supporting portion 1. However, the present invention is not limited to this arrangement. For example, as shown in FIG. 7, restricted position P may be arranged to any desired position of anti-vibration floor 2, a plurality of spring mechanisms 12 may be radially arranged with respect to restricted position P, and movable supporting portion 1, viscous damper 4 and spring mechanism 12 may be independently arranged. This arrangement can be applied to additional embodiments which will be discussed hereinafter.

In the above discussed embodiment, one end of spring mechanism 12 is coupled with fixed floor 3 as a part of the building, but another embodiment may be available. One end of spring mechanism 12 may be coupled with a vertical construction member, such as a wall or a pillar of the building. Spring mechanism 12 is not only limited to be provided horizontally but also is provided in any direction and any plane of three dimensional space.

In the above discussed embodiment, spring mechanism 12 is positioned between anti-vibration floor 2 and fixed floor 3 in parallel with fixed floor 3. However, in the upper side of anti-vibration floor 2, one end of spring mechanism 12 may be fixed to anti-vibration floor 2 and the other end thereof may be fixed to the wall or pillar of the building, such that spring mechanism 12 can be arranged at any angle in horizontal or vertical. Moreover, spring mechanism 12 may be arranged at any angle to the vertical under anti-vibration floor 2. This arrangement can be applied another embodiment which will be discussed hereinafter.

The pre-tension introduction mechanism is not limited to sleeve type dial 22 using the thread or screw operation. The pre-tension introduction mechanism can be made by using many kinds of mechanisms for expanding and compressing tension spring 11 wound around the outer surface of the cylinder.

As was described about the embodiments of the present invention hereinbefore, the floor vibration-damping apparatus of the present invention can be applied to any conditions regardless of shape, construction, application, set place or the like of anti-vibration floor 2. Thus, the invention is of utility in many kinds of applications.

It is easy to introduce or correct the pre-tension for the trigger function, and this operation can be done at the factory or the building site. Thus, the best vibration-damping effect can be established easily and certainly in consideration of design and actual usage state.

In addition, the invention does not require reaction bases, flat bars and stoppers which are necessary for a conventional trigger function, so that the invention can reduce a number of usage parts, be easy in setting and be inexpensive.

While the preferred embodiments of the present invention have been shown and described herein, it will be apparent to those skilled in the art that many changes and modifications may be made without departing from the invention in its broader aspects. Therefore, the scope of the present invention should be determined only by the following claims.

We claim:

1. A floor vibration-damping apparatus for damping movement of an anti-vibration floor relative to a building, comprising:

a movable supporting portion supporting the anti-damping floor so that it is able to move horizontally relative to the building, a viscous damper effective between the building and the anti-vibration floor, and a plurality of spring mechanisms each having two opposite ends and fixed at one end to a selected restriction position of the anti-vibration floor and at the other end to the building, each spring mechanism comprising a tension spring and a pre-tensioning device distinct from the building for pre-tensioning the spring.

2. Apparatus according to claim 1, wherein the viscous damper comprises a vessel fixed to the building and containing a viscous fluid, and a resistance plate fixed to the anti-vibration floor and submerged in the viscous fluid.

3. Apparatus according to claim 1, wherein the spring mechanisms extend radially from said selected restriction position and are substantially equiangularly spaced thereabout.

4. Apparatus according to claim 1, wherein each tension spring has first and second ends, each spring mechanism comprises a chain having a first end fixed directly to the floor at said selected restriction position and a second end fixed to the spring at said first end thereof, and the spring is fixed at its second end directly to the building.

5. Apparatus according to claim 1, wherein said selected restriction position of the anti-vibration floor substantially coincides with said movable supporting portion.

6. Apparatus according to claim 1, wherein said selected restriction position of the anti-vibration floor is spaced from said viscous damper.

7. Apparatus according to claim 1, wherein the tension spring has first and second opposite ends and the pre-tensioning device comprises a first spring attachment member attached to the spring at the first end thereof, a second spring attachment member attached to the spring at the second end thereof, and spacer means distinct from the building for preventing the distance between the second spring attachment member and the first spring attachment member from falling below a predetermined minimum value.

8. Apparatus according to claim 7, wherein the spacer means comprise a rod structure having first and second opposite ends, an externally threaded member projecting from the rod structure at the second end thereof, and an internally threaded sleeve in threaded engagement with the externally threaded member, the first spring attachment member being secured to the rod structure at the first end thereof and the second spring attachment member being secured to the internally threaded sleeve.

9. Apparatus according to claim 1, wherein the tension spring is a coil spring having first and second opposite ends and the pre-tensioning device comprises a cylinder member coupled to the building and extending coaxially within the coil spring, a plunger coupled to the anti-vibration floor and slideably fitted in the cylinder member, a first spring attachment member that moves with the plunger and is attached to the spring at the first end thereof, a second spring attachment member that is attached to the spring at the second end thereof, and adjustment means for selectively displacing the second spring attachment member longitudinally of the cylinder.

10. Apparatus according to claim 9, comprising an externally threaded rod that projects from the cylinder, and wherein the adjustment means comprise an internally threaded sleeve in threaded engagement with the rod and to which the second spring attachment member is attached, whereby rotation of the sleeve relative to the rod influences the tension of the spring.

11. Apparatus according to claim 10, wherein each spring mechanism comprises a flexible coupling member that is connected at one end to the anti-vibration floor and is connected at its other end to the plunger of the spring mechanism, and the externally threaded rod is a tie rod that is connected to the building.

12. Apparatus according to claim 11, wherein the flexible coupling member is a chain.

* * * * *